US007509773B2

(12) United States Patent
Vornbäumen et al.

(10) Patent No.: US 7,509,773 B2
(45) Date of Patent: Mar. 31, 2009

(54) SLIDING WINDOW, IN PARTICULAR FOR A MOTOR VEHICLE

(75) Inventors: Jens Vornbäumen, Altena (DE); Joachim Volke, Plettenberg (DE); Holger Rau, Reichshof (DE)

(73) Assignee: Dura Automotive Plettenberg Entwicklungs-und Vertriebs GmbH, Plettenberg (DE)

( * ) Notice: Subject to any disclaimer, the term of this patent is extended or adjusted under 35 U.S.C. 154(b) by 482 days.

(21) Appl. No.: 11/241,855

(22) Filed: Sep. 30, 2005

(65) Prior Publication Data

US 2006/0064934 A1 Mar. 30, 2006

(30) Foreign Application Priority Data

Sep. 30, 2004 (DE) ..... 10 2004 047 629

(51) Int. Cl.
*E05F 11/40* (2006.01)

(52) U.S. Cl. ..... 49/362; 49/209; 49/213; 49/380

(58) Field of Classification Search ..... 49/360, 49/362, 324, 348, 349, 209, 210, 213, 414, 49/380

See application file for complete search history.

(56) References Cited

U.S. PATENT DOCUMENTS 4,260,189 A * 4/1981 Periou et al. ..... 296/223
4,438,972 A * 3/1984 Katayama et al. ..... 296/223
4,541,202 A * 9/1985 Dockery ..... 49/362
4,852,422 A * 8/1989 Mori ..... 74/502.6
4,920,698 A * 5/1990 Friese et al. ..... 49/380
4,979,261 A * 12/1990 Lasier et al. ..... 16/62
5,146,712 A * 9/1992 Hlavaty ..... 49/118
5,531,046 A * 7/1996 Kollar et al. ..... 49/360
5,724,769 A * 3/1998 Cripe et al. ..... 49/360
5,784,833 A * 7/1998 Sponable et al. ..... 49/360
5,822,922 A * 10/1998 Grumm et al. ..... 49/360
5,826,377 A * 10/1998 Simson et al. ..... 49/362
6,112,462 A * 9/2000 Kolar ..... 49/121
6,119,402 A * 9/2000 Wisner ..... 49/362
6,125,585 A * 10/2000 Koneval et al. ..... 49/349
6,250,013 B1 * 6/2001 Apprich ..... 49/362
6,256,930 B1 * 7/2001 Faubert et al. ..... 49/362
6,324,788 B1 * 12/2001 Koneval et al. ..... 49/121
6,435,600 B1 * 8/2002 Long et al. ..... 296/155
6,446,696 B1 * 9/2002 Davies et al. ..... 160/243
6,729,072 B1 * 5/2004 Somnay et al. ..... 49/362
7,204,544 B2 * 4/2007 Hermansson ..... 296/155
2001/0015033 A1 * 8/2001 Minami ..... 49/324
2001/0027621 A1 * 10/2001 Davies et al. ..... 49/360
2004/0187390 A1 * 9/2004 Celani ..... 49/360
2004/0244295 A1 * 12/2004 Derham et al. ..... 49/362
2005/0160674 A1 * 7/2005 Noro et al. ..... 49/360
2005/0252089 A1 * 11/2005 Hermansson ..... 49/360

* cited by examiner

*Primary Examiner*—Katherine W Mitchell
*Assistant Examiner*—Catherine A Kelly
(74) *Attorney, Agent, or Firm*—Porter, Wright, Morris & Arthur, LLP

(57) ABSTRACT

A sliding window for a vehicle, in particular a motor vehicle, comprises a fixed component and a moving component. To provide a drivable sliding window, a drivable pinion (3) is rotatably supported at the fixed component and a rack (2) is provided at the moving component and the pinion (3) engages into it.

14 Claims, 6 Drawing Sheets

Closed

Open

SLIDING WINDOW, IN PARTICULAR FOR A MOTOR VEHICLE

CROSS-REFERENCE TO RELATED APPLICATIONS

Not Applicable

STATEMENT REGARDING FEDERALLY SPONSORED RESEARCH

Not Applicable

REFERENCE TO MICROFICHE APPENDIX

Not Applicable

FIELD OF THE INVENTION

The invention relates to a sliding window for a vehicle, in particular a motor vehicle, comprising a fixed component and a moving component. The invention furthermore relates to a vehicle, in particular a motor vehicle, comprising a sliding window of this type. The fixed component and/or the moving component is in particular a window. It is possible that a plurality of moving components or windows are provided in one fixed component. The moving component(s) or window(s) are preferably slidable. The sliding window can be installed in a vehicle door or vehicle gate. It can, however, also be a component of the vehicle body,

BACKGROUND OF THE INVENTION

Sliding windows, in particular sliding windows flush with an external surface, are manually operated in previously known embodiments. In the known embodiments, the moving component must first be moved out of the closed position into the vehicle interior. It can then be slid behind the fixed component, with this movement being able to take place substantially parallel to the fixed component.

A sliding window for a motor vehicle door in accordance with the preamble of claim 1 is known from EP 0 968 862 A2.

It is an object of the invention to provide a drivable sliding window of the type first recited.

SUMMARY OF THE INVENTION

The object is solved in accordance with the invention by the features of claim 1. A drivable pinion is rotatably supported at the fixed component and engages into a rack provided at the moving component. The sliding window can hereby be power driven.

Advantageous further developments are described in the dependent claims.

The rack can be made as a toothed cam.

It is advantageous for the moving component to be substantially flush with the fixed component in the closed position of the sliding window. A particularly appealing appearance is hereby allowed.

The pinion is preferably drivable by a motor, in particular an electric motor. It is advantageous if the motor is a geared motor. The pinion can be directly drivable by the motor. It can, however, also be indirectly drivable by the motor, for example via a shaft, a flexible shaft, a belt drive, a chain drive or control cable or similar.

In accordance with an advantageous further development, the fixed component has one or more guide rails.

Guide rails or other guide elements or guide tracks for pins or other guide elements present on the moving component can be provided in the guide rail(s). The pins or other guide elements can preferably be dismantled.

In accordance with a further advantageous further development, the guide grooves can extend parallel to one another. The guide grooves are in particular flush with one another.

It is advantageous for the guide rails to be manufactured as an extruded part. This is in particular advantageous when the guide grooves are flush with one another. With certain size ratios of the moving component, the guide rail can be made such that the guide grooves are flush with one another. In this case, the guide rail can advantageously be manufactured as an extruded part, which is in particular cost-saving with small volumes.

It can be advantageous in specific cases to make the guide rails as hybrid components in shell construction.

It is advantageous for the drivable pinion to be rotatably supported in the guide rail.

In accordance with a further advantageous embodiment, the rack or toothed cam is integrated into the molding, in particular the plastic molding, of the moving component. The rack or toothed cam can be inserted into the molding of the moving component, i.e. can be realized as an insertion part. It is, however, also possible to inject the rack or toothed cam directly. In this solution, the molding including the rack or toothed cam is injected in a part. The molding can be made as a one-component injection molding or a two-component injection molding.

A further advantageous further development is characterized in that the rack or toothed cam has a section for the movement of the moving component along the fixed component. This movement can take place in a plane substantially parallel to the fixed component, preferably on the inner side of the fixed component.

In a further advantageous development, the rack or toothed cam has a section for the movement of the moving component into the closed position. This movement preferably leads out of the plane extending substantially parallel to the fixed component. It preferably moves the moving component into a plane extending substantially parallel to the fixed component. The mentioned section of the rack or toothed curve also serves the reverse movement, i.e. for the movement from the closed position into the open position.

A protection against jamming is provided in accordance with a further advantageous further development. The protection against jamming can take place by a motor control, e.g. by a change in the power consumption of the electric motor at specific path segments which are defined by a sensor, in particular a Hall sensor. Instead or in addition, the protection against jamming can take place by contacting seals which switch off the motor or switch over the running direction on contact with an obstacle, for example a jammed finger or a jammed hand. The protection against jamming can instead or additionally furthermore be realized by an optical sensor in combination with the motor control.

It is advantageous for the motor or geared motor to have a self-braking function. The motor or geared motor can be connected to the moving component via mechanical elements. A self-braking function can be realized at this position. It can be achieved by the self-braking function in the motor or geared motor or in the mechanical elements with which the motor or geared motor is connected to the moving component that the moving component is also reliably fixed in any position under operating influences, in particular in driving operation.

The invention furthermore relates to a vehicle, in particular a motor vehicle, comprising a sliding window in accordance with the invention, with the vehicle or motor vehicle being characterized in accordance with the invention in that the fixed component is substantially flush with the vehicle part surrounding it. The sliding window is therefore inserted into the vehicle part, for example into a vehicle door, a vehicle gate or a body part, flush with an external surface. This is in particular of advantage when the moving component is flush with the fixed component in the closed position of the sliding window. In this case, the moving component, the fixed component and the surrounding vehicle part appear as a single, flush surface, which effects a particularly appealing appearance.

BRIEF DESCRIPTION OF THE DRAWINGS

Embodiments of the invention will be explained in detail in the following with reference to the enclosed drawing. There are sown in the drawing.

DETAILED DESCRIPTION OF CERTAIN PREFERRED EMBODIMENTS

Figure 1:
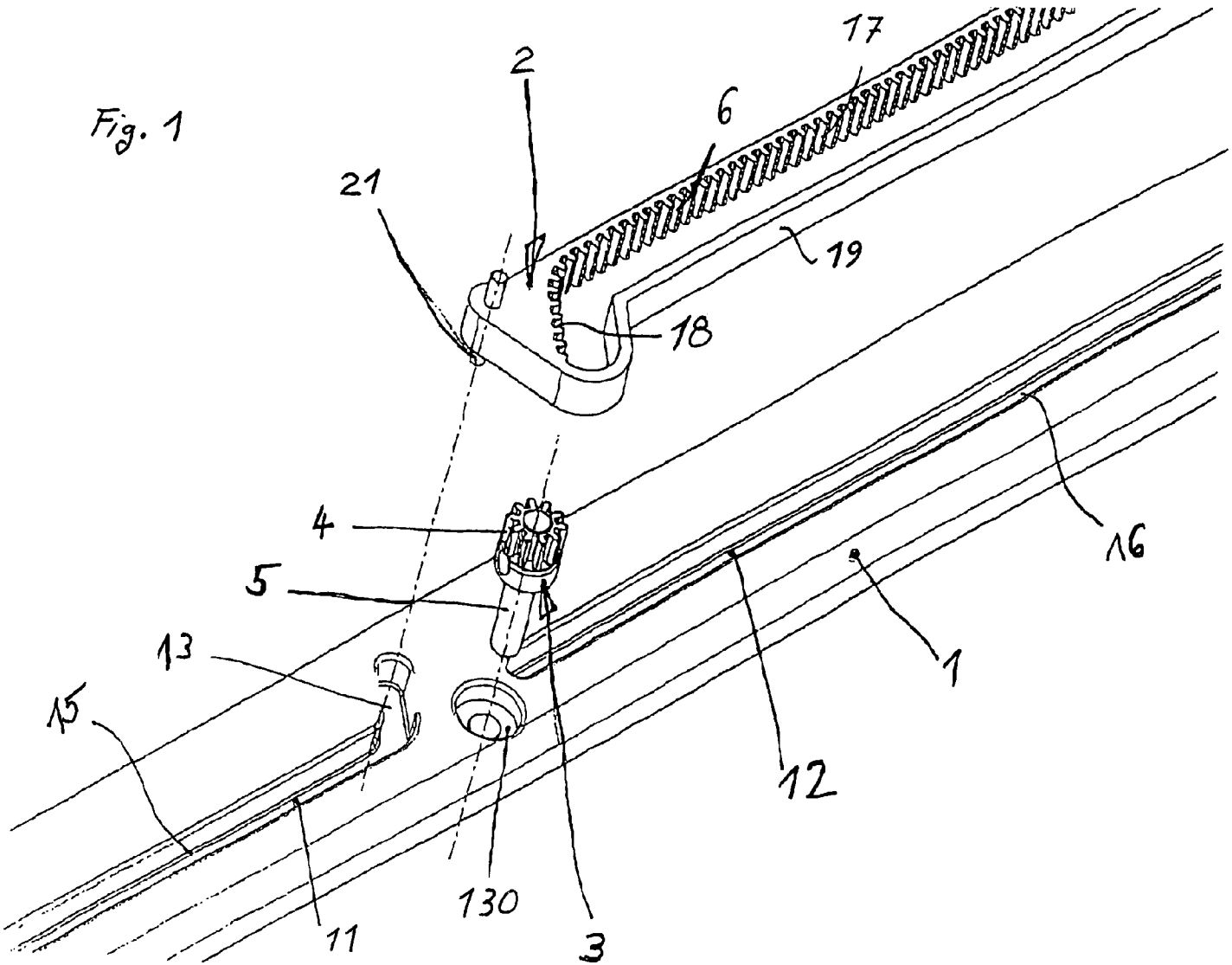
FIG. 1 is a part of a guide rail, a pinion and a part of a toothed curve of a first embodiment in a perspective exploded view.

In FIG. 1, the middle part region of a guide rail 1 is shown which is secured to a fixed component, namely to a fixed window, of a motor vehicle. The guide rail 1 is manufactured as an extruded part with inserts. It has a first guide groove 11 and a second guide groove 12 which each extend in the longitudinal direction of the guide rail 1 and which are flush with one another. The right end of the first guide groove 11 and the left end of the second guide groove 12 are spaced apart from one another. In the region of this spacing, a recess 130 is provided between the guide grooves 11, 12, in the guide rail 1 and a pinion 3 is rotatably supported therein. The pinion 3 comprises a peripheral ring gear 4, which projects upwardly out of the recess 130 in the assembled position, and a pin 5 which is rotatably supported in the recess 130. The pin 5 is furthermore drivable by an electric motor (not shown in the drawing). The electric motor can be fastened to the guide rail 1 or to another part of the fixed component or to another part of the vehicle.

A rack which is made as a toothed cam 2 and has a toothed arrangement 6 and two guide pins 21, 22 is fastened to the moving part which is made as a moving window (not shown in the drawing). The toothed cam 2 can be integrated in the molding of the moving component. The first guide pin 21 engages into the first guide groove 11; the second guide pin 22 engages into the second guide groove 12. Furthermore, in the assembled state, the ring gear 4 of the pinion 3 engages into the toothed arrangement 6 of the toothed cam 2. The pins 21, 22 can be dismantled.

The guide grooves 11, 12 each have a first section 15, 16 and a second section 13, 14. The first sections 15, 16 are made in a straight line. They extend in the longitudinal direction of the guide rail 1. The second sections 13, 14 extend at an angle of approximately 45 degrees to the first sections 15, 16. The toothed cam 2, and with it the moving component, is moved along the fixed component by the first sections 15, 16. This movement takes place in a plane which extends substantially parallel to that of the fixed component and which is disposed on the inner side of the fixed component.

The second sections 13, 14 serve to guide the toothed cam 2, and with it the moving component, out of this plane into the closed position in which the external surface of the moving component is substantially flush with the external surface of the fixed component.

In a corresponding manner, the toothed arrangement 6 of the toothed cam 2 has a section 17 which extends in the longitudinal direction of the guide rail 1 and a section 18 which extends at an angle of approximately 45 degrees thereto. The toothed arrangement 6 is a straight-line toothed arrangement. It can also be made as a slanted toothed arrangement, which incurs a higher manufacturing effort and/or expense, but whereby the running smoothness is increased, the noise formation during operation is reduced and the mechanical strain is lowered and thus the service life can be increased. In the embodiment in accordance with FIGS. 1, 2, and 3, the toothed cam 2 is closed by a peripheral web 19. The peripheral web 19 extends parallel to the toothed arrangement 6 of the toothed cam 2 and spaced apart therefrom, with the spacing substantially corresponding to the diameter of the ring gear 4 of the pinion 3.

Figure 4:
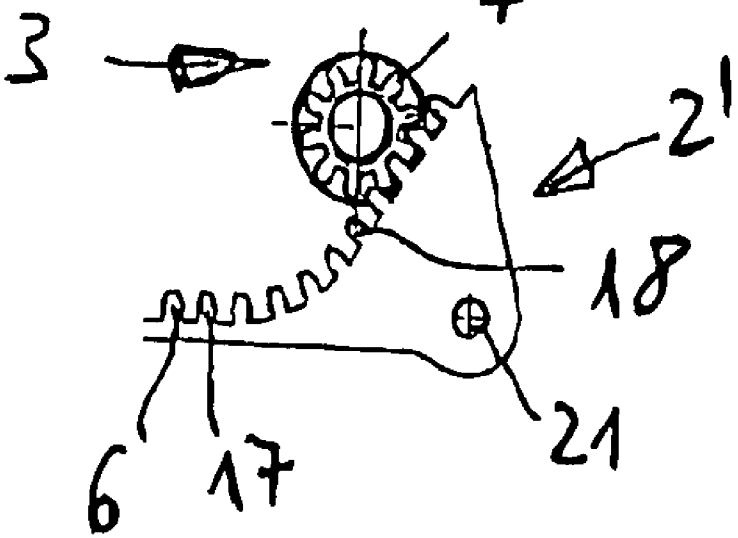
FIG. 4 is a modification of the toothed cam in a representation corresponding to FIG. 3.
Figure 5:
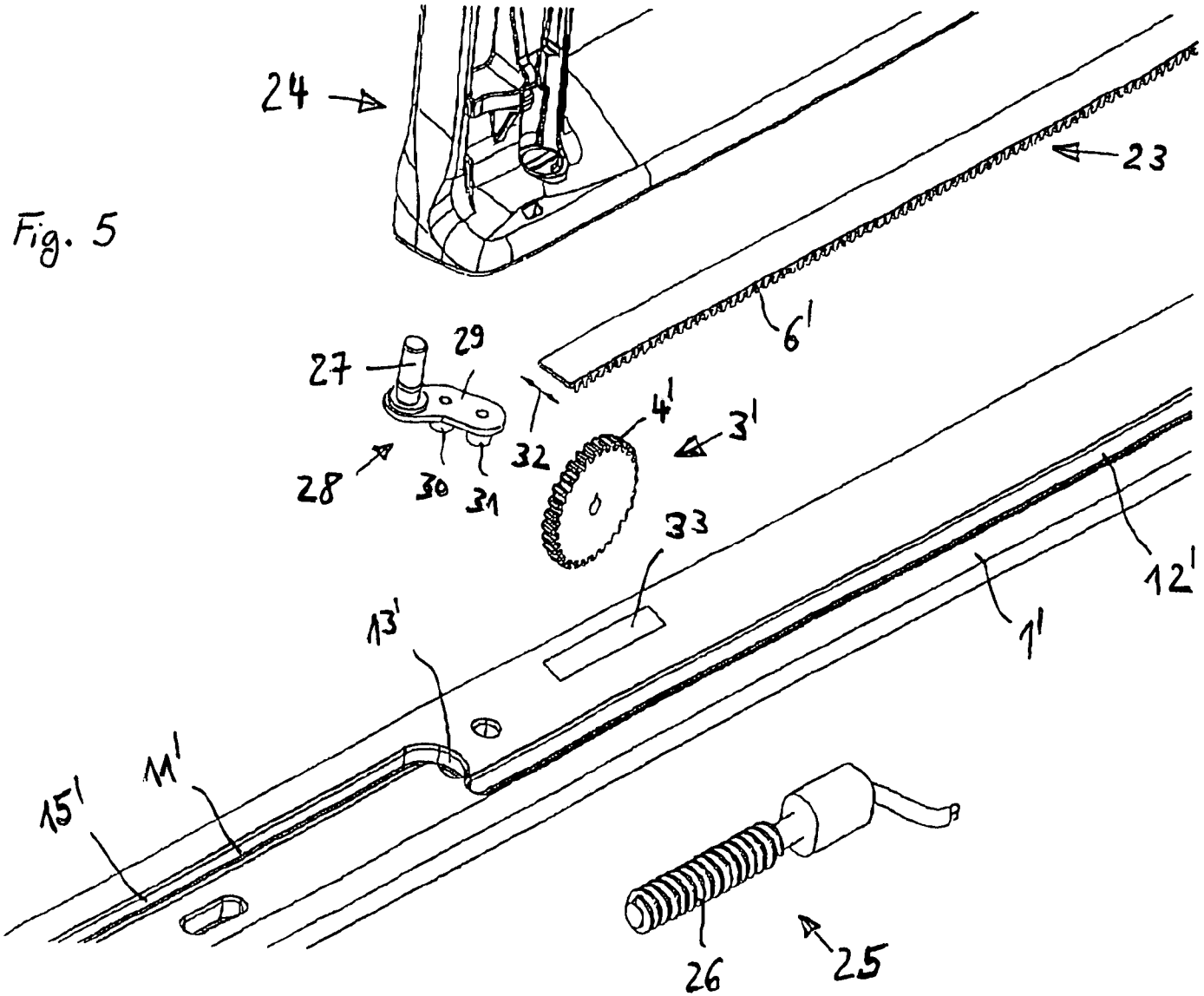
FIG. 5 is a part of a guide rail, a pinion and a part of a toothed curve of a second embodiment in a perspective exploded view.
Figure 6:
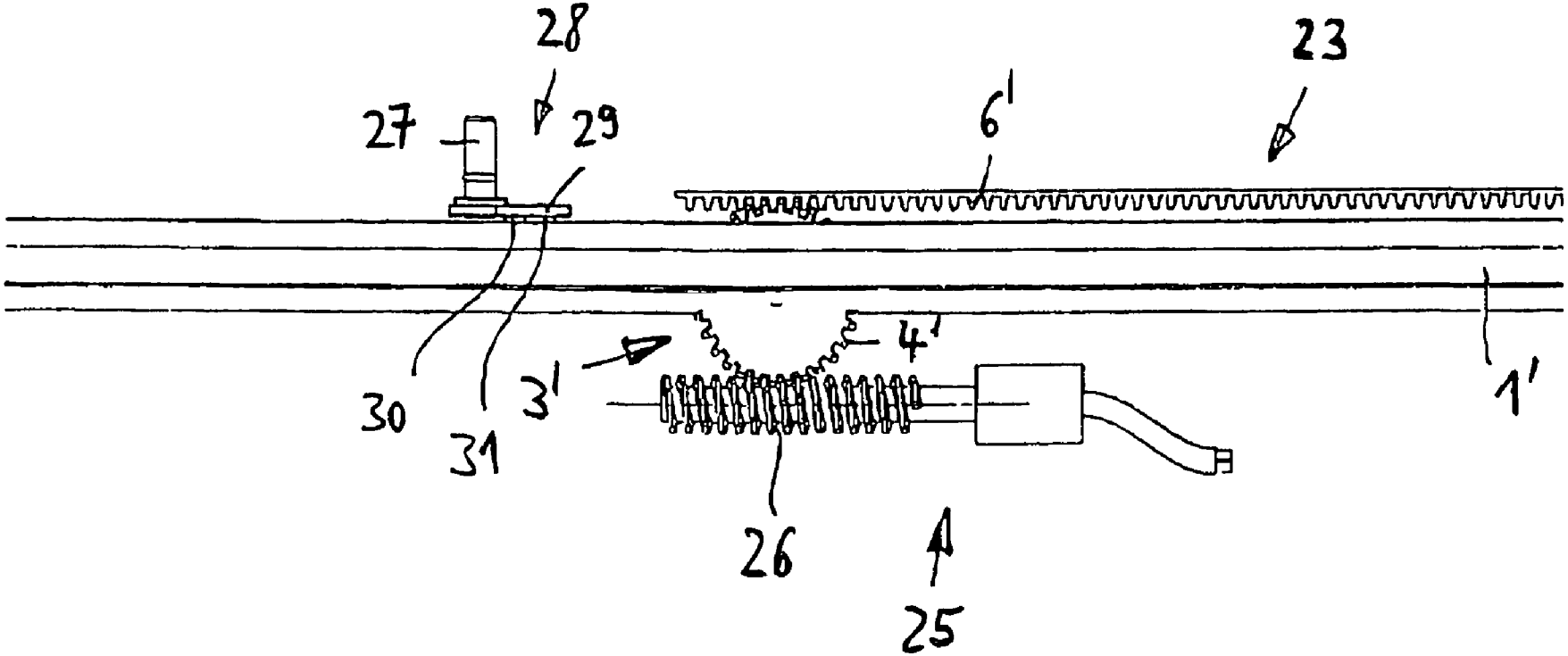
FIG. 6 is the parts in accordance with FIG. 5 in the assembled state in a side view.
Figure 8:
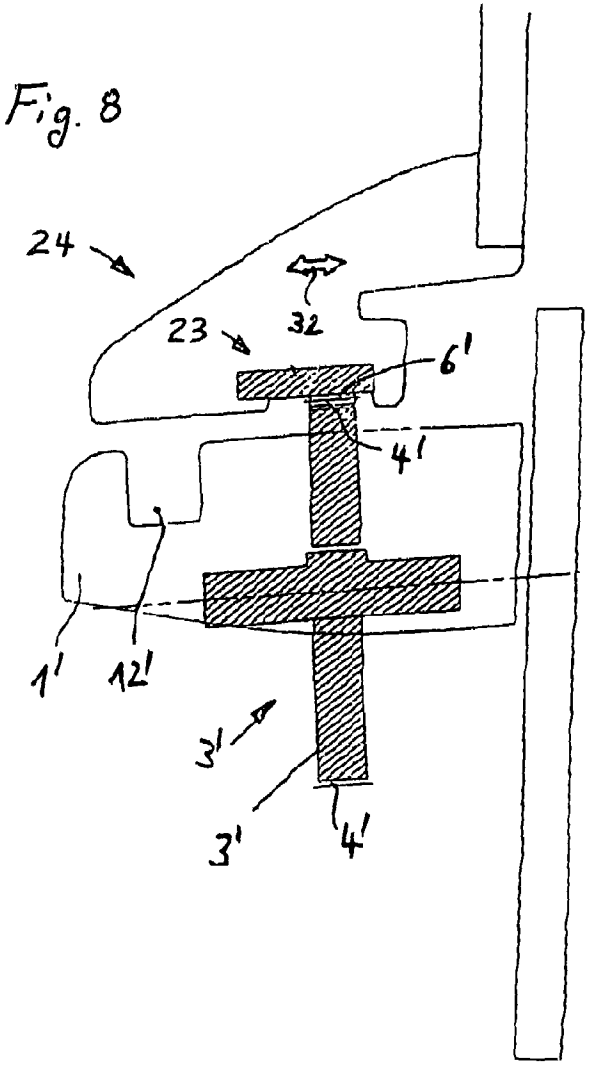
FIG. 8 is a cross-section corresponding to FIG. 7 with an open window.
Figure 7:
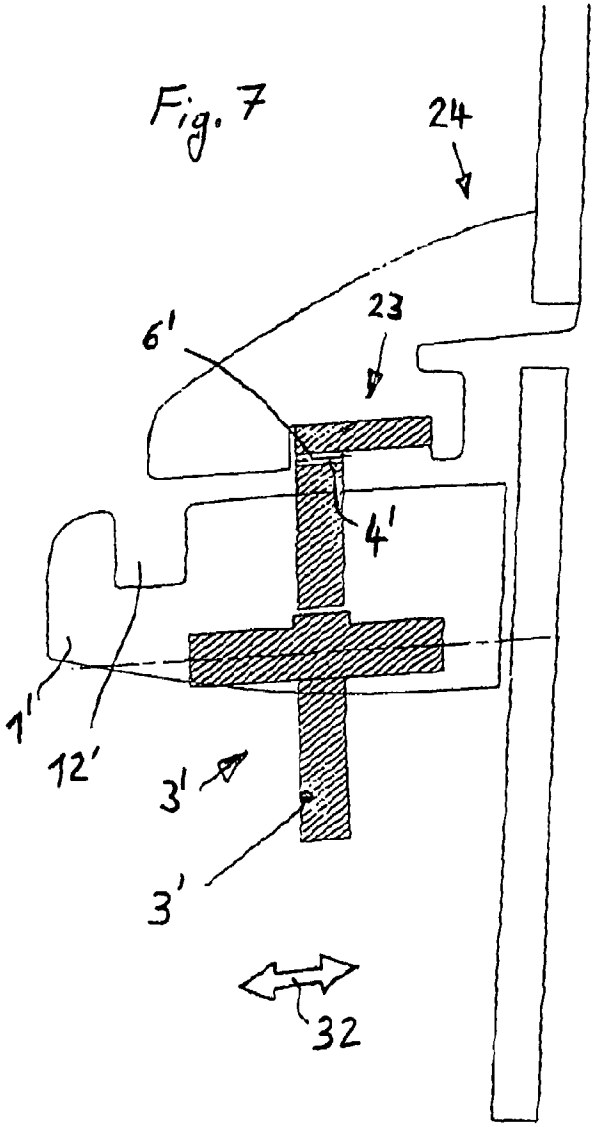
FIG. 7 is a cross-section through the guide rail in accordance with FIG. 5 with a closed window.

In FIG. 4, a modified embodiment is shown in which the toothed cam 2' is made open. The peripheral web 19 is omitted here.

The section 17 of the toothed arrangement 6 serves the movement of the moving component along the fixed component. The section 18 of the toothed arrangement 6 serves the movement of the moving component into the closed position.

The electric motor realized as a geared motor can drive the pinion 3 directly. It can, however, also drive the pinion 3 indirectly, for example via a flexible shaft, a fixed or a flexible threaded element or a rack or a toothed belt. The motion of the moving component is predetermined by the guide grooves 11, 12 in the guide rail 1 in which the guide pins 21, 22 slide.

Figure 2:
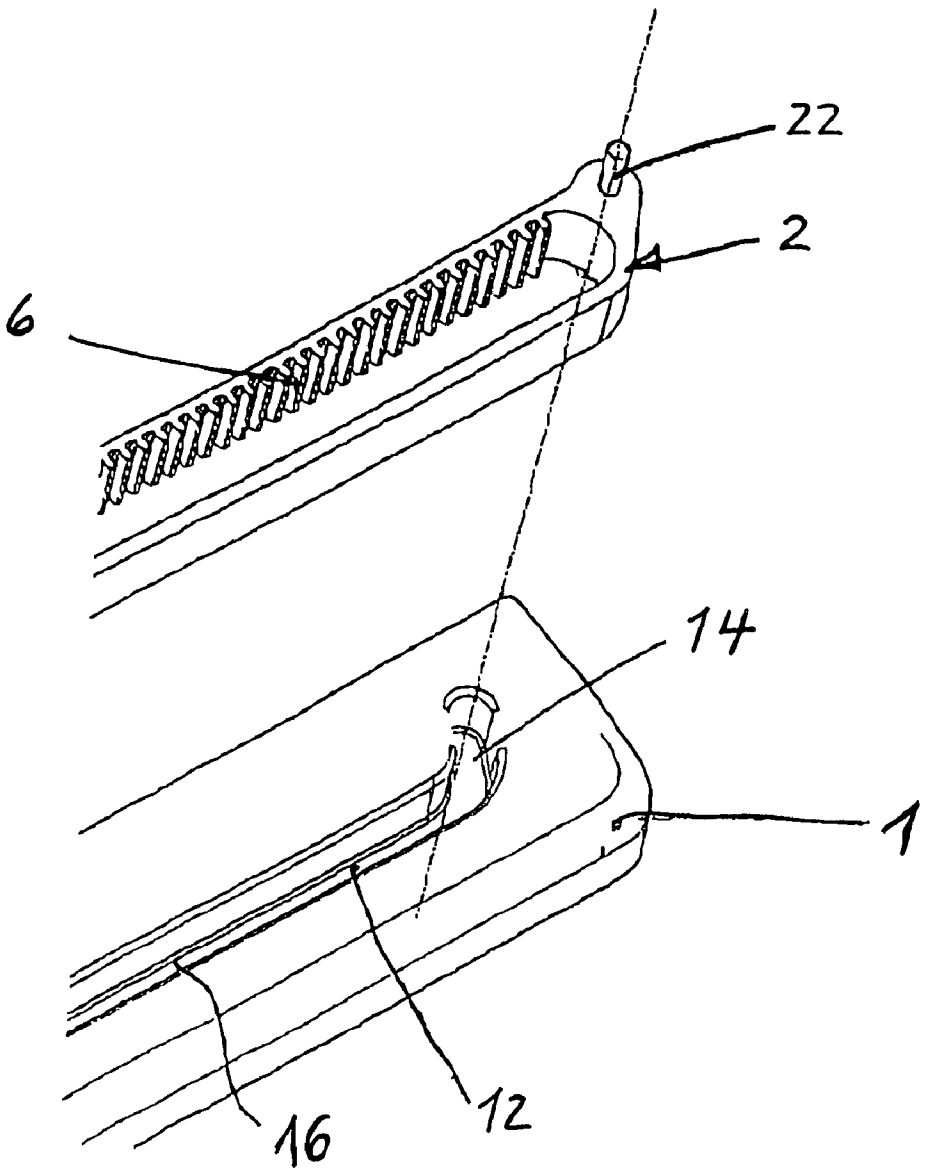
FIG. 2 is another part of the guide rail and the toothed curve in a perspective exploded view.
Figure 3:
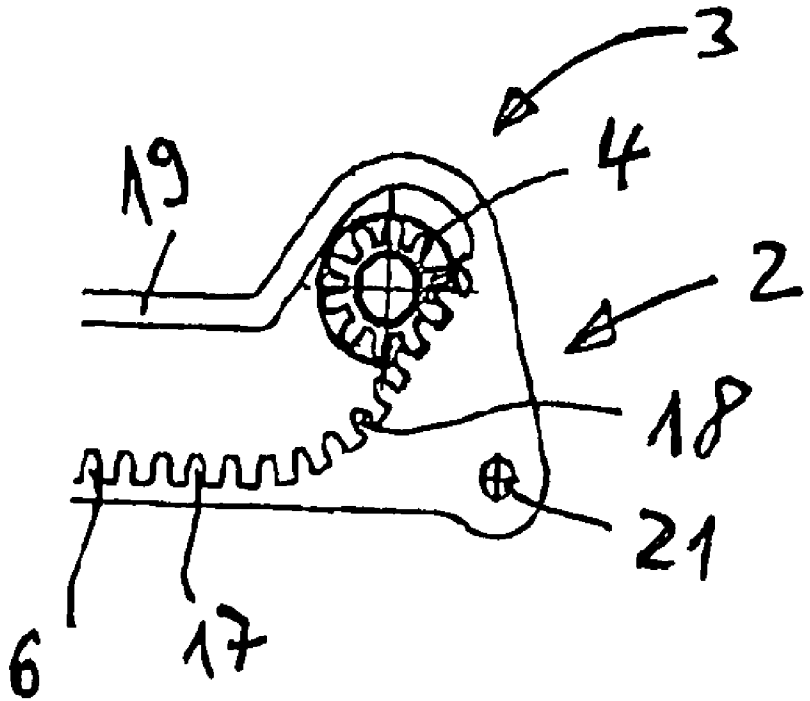
FIG. 3 is the pinion and the toothed cam in accordance with FIG. 1 in a plan view.

In the embodiment in accordance with FIGS. 1 to 3 and in the variant in accordance with FIG. 4, the teeth of the toothed arrangement 6 of the toothed cams 2, 2' face in the horizontal direction and the axis of rotation of the ring gear 4 of the pinion 3 extends in the vertical direction. In the second embodiment shown in FIGS. 5 to 8, in contrast, the teeth of the toothed arrangement 6' of the rack 23 face in the vertical direction and the axis of rotation of the ring gear 4' of the pinion 3' extends in the horizontal direction. The guide rail 1' fastened to a fixed component, namely to a fixed window, of a motor vehicle has a first guide groove 11' and a second guide groove 12' which each extend in the longitudinal direction of the guide rail 1' and which are mutually spaced apart parallel to one another. The first section 15' of the first guide groove 11' is made in a straight line. A second section 13' adjoins it and is curved toward the left end of the second guide groove 12'.

In the region of the left end of the second guide groove 12', a recess 33 is provided in the guide rail 1' and a pinion 3' is rotatably supported in it about a horizontal axis extending transversely to the longitudinal direction of the guide rail 1'. The pinion 3' comprises a peripheral ring gear 4' made of a straight-toothed end face toothed arrangement. A slanted toothed arrangement can also be provided instead of a straight toothed arrangement, which brings along the aforesaid advantages.

The ring gear 4' engages into the toothed arrangement 6' at the rack 23 which is fastened to the lower side of the moving component 24, namely to the frame of a moving window for a motor vehicle.

The pinion 3' is driven by a geared motor 25 which is provided beneath the guide rail 1 and whose output shaft drives a worm 26, which engages into the ring gear 4' of the pinion 3', about a horizontal axis extending in the longitudinal direction of the guide rail 1'.

A bore is present at the lower side of the frame of the moving component 24 for a pin 27 which is provided at a relay arm 28 which has a base plate 29 and two guide pins 30, 31 spaced apart and projecting downwardly from this. In the assembled state, the guide pins 30, 31 are disposed in the first guide groove 11'. A corresponding guide part (not shown in the drawing) is present at the other end of the frame of the moving component 24. The sections 15', 13' of the guide groove 11' are realized such that the moving window 24 is flush with the fixed window in the closed position and such that it is moved from this closed position in a direction toward the interior of the vehicle on the opening of the window and is subsequently displaced parallel to the fixed window. On the movement of the moving window 24 out of the plane of the fixed window and into this plane, that is on the movement in a horizontal direction indicated by the double arrow 32 transversely to the longitudinal axis of the vehicle, the rack 23 also caries out this movement. The rack 23 slides over the ring gear 4' of the pinion 3' in the manner visible from FIGS. 7 and 8. To compensate for this movement, the width of the toothed arrangement 6' is larger than that of the ring gear 4' in order to ensure that the ring gear 4' remains in engagement with the toothed arrangement 6' in all positions of the moving component 24. The width of the toothed arrangement 6' corresponds to its path in the direction 32 which is covered on the movement of the moving component 24 from the closed position in accordance with FIG. 7 into the open position in accordance with FIG. 8.

Since the moving component can be driven in the manner described, a number of components can be omitted which are required on a manual actuation of the moving component. Furthermore, the further advantage can be achieved that less construction space is required in the viewing region and no covers are required for the handle mechanism, which promotes the quality appearance of the sliding window. A further advantage which can be achieved with the invention consists of higher closing forces being able to be achieved than with a comfortable manual actuation. The tightness of the sliding window can hereby be increased, in particular with "flush sliding windows" in which the moving component is flush with the fixed component in the closed position. A further achievable advantage consists of the increase in comfort by simple button operation of the window, optionally from a different position in the vehicle, and also by a possible remote control, in particular a radio remote control or an infrared remote control.

What is claimed is:

1. A sliding window for a vehicle, comprising:

a fixed component;

a moving component;

a drivable pinion (3, 3') rotatably supported by the fixed component;

a rack (2, 2', 23) defining a slot mounted to the moving component and into which the pinion (3, 3') is inserted for engagement;

wherein the rack is made as a toothed cam;

pins mounted on the moving component;

wherein the fixed component has at least one guide rail;

wherein guide grooves are provided in the guide rail and receive the pins;

wherein the drivable pinion is rotatably supported in the guide rail;

wherein the rack has a section for the movement of the moving component along the fixed component;

wherein the rack has a section for the movement of the moving component into a closed position; and wherein the guide grooves each have a first section for the movement of the moving component substantially parallel to the fixed component and a second section at an angle to the first section for the movement of the moving component into the closed position.

2. A sliding window in accordance with claim 1, wherein the moving component is substantially flush with the fixed component when said moving component is in said closed position.

3. A sliding window in accordance with claim 1, wherein the pinion (3, 3') is drivable by a motor.

4. A sliding window in accordance with claim 1, wherein the pins (21, 22, 30, 31) can be removed from the moving component.

5. A sliding window in accordance with claim 1, wherein the guide rail (1, 1') is manufactured as an extruded part.

6. A sliding window in accordance with claim 1, wherein the guide rail is manufactured as a hybrid component.

7. A sliding window in accordance with claim 1, wherein the rack (2, 2', 23) is integrated into a molding of the moving component.

8. A sliding window in accordance with claim 1, further comprising means for protecting against jamming of the movable component.

9. A sliding window in accordance with claim 3, wherein the motor has a self-braking function.

10. A sliding window:

in accordance with claim 1, wherein the fixed component is substantially flush with a vehicle part surrounding the fixed component when.

11. A sliding window in accordance with claim 1, wherein the slot is defined by a peripheral flange.

12. A sliding window in accordance with claim 11, wherein the peripheral flange extends parallel to a toothed arrangement of the toothed cam and is spaced apart therefrom to define said slot.

13. A sliding window in accordance with claim 12, wherein the peripheral flange is spaced apart from the toothed arrangement by a distance substantially corresponding to a ring gear of the pinion.

14. A sliding window in accordance with claim 1, wherein the first and second sections of the guide grooves are each straight.

* * * * *